US010532916B2

(12) United States Patent
Hayashi

(10) Patent No.: US 10,532,916 B2
(45) Date of Patent: Jan. 14, 2020

(54) WORKING MACHINE

(71) Applicant: TADANO LTD., Kagawa (JP)

(72) Inventor: Hiroyuki Hayashi, Kagawa (JP)

(73) Assignee: TADANO LTD., Kagawa (JP)

( * ) Notice: Subject to any disclaimer, the term of this patent is extended or adjusted under 35 U.S.C. 154(b) by 114 days.

(21) Appl. No.: 15/576,902

(22) PCT Filed: Oct. 6, 2016

(86) PCT No.: PCT/JP2016/079858
§ 371 (c)(1),
(2) Date: Nov. 27, 2017

(87) PCT Pub. No.: WO2017/061573
PCT Pub. Date: Apr. 13, 2017

(65) Prior Publication Data

US 2018/0148303 A1 May 31, 2018

(30) Foreign Application Priority Data

Oct. 8, 2015 (JP) ..... 2015-200125

(51) Int. Cl.

| | |
|---|---|
| ***B66C 13/40*** | (2006.01) |
| ***B66C 23/42*** | (2006.01) |
| ***B66C 13/56*** | (2006.01) |
| ***B66C 23/88*** | (2006.01) |
| ***B66C 13/44*** | (2006.01) |
| ***B66C 15/00*** | (2006.01) |

(52) U.S. Cl.
CPC ..... *B66C 13/40* (2013.01); *B66C 13/44* (2013.01); *B66C 13/56* (2013.01); *B66C 15/00* (2013.01); *B66C 23/88* (2013.01); *B66C 23/42* (2013.01); *B66C 2700/088* (2013.01)

(58) Field of Classification Search
CPC ..... B66C 13/40; B66C 23/42; B66C 15/00
USPC ..... 701/2
See application file for complete search history.

(56) References Cited

FOREIGN PATENT DOCUMENTS

| | | |
|---|---|---|
| CN | 102123934 A | 7/2011 |
| JP | H01-085967 U1 | 6/1989 |
| JP | 2644352 B2 | 8/1997 |

(Continued)

OTHER PUBLICATIONS

Dec. 27, 2016, International Search Report issued for related international application No. PCT/JP2016/079858.

(Continued)

*Primary Examiner* — Khoi H Tran
*Assistant Examiner* — Rodney P King
(74) *Attorney, Agent, or Firm* — Paratus Law Group, PLLC

(57) ABSTRACT

A working machines capable of securing safety while enabling remote operation is a working machine configured to be capable of communicating with a remote operation device (40), and includes a communication unit (70*a*) that receives a manipulate signal from the remote operation device (40), a control unit (70) that controls actuators (51 to 59) mounted in the working machine according to manipulate signals from main operation devices disposed in a cab of the working machine or the remote operation device (40). In a case where a state of the working machine does not fulfill a predetermined condition, the control unit (70) does not allow the remote operation of at least one of the actuators (51 to 59) by the remote operation device (40).

4 Claims, 5 Drawing Sheets

(56) References Cited

FOREIGN PATENT DOCUMENTS

| | | | | |
|---|---|---|---|---|
| JP | 2740035 | B2 | | 4/1998 |
| JP | 2004-284729 | A | | 10/2004 |
| JP | 2004-331323 | A | | 11/2004 |
| JP | 2004331323 | A | * | 11/2004 |

OTHER PUBLICATIONS

Dec. 13, 2016, International Search Opinion issued for related international application No. PCT/JP2016/079858.

* cited by examiner

WORKING MACHINE

CROSS REFERENCE TO PRIOR APPLICATION

This application is a National Stage Patent Application of PCT International Patent Application No. PCT/JP2016/079858 (filed on Oct. 6, 2016) under 35 U.S.C. § 371, which claims priority to Japanese Patent Application No. 2015-200125 (filed on Oct. 8, 2015), which are all hereby incorporated by reference in their entirety.

TECHNICAL FIELD

The present invention relates to a working machine.

BACKGROUND ART

Conventionally, there has been proposed a remote operation device that operates an actuator from the outside of a cab in a working machine such as a mobile crane. In addition, there have been developed techniques and the like with which an auxiliary operation board connected to a control unit via a cable is provided separately from a main operation device disposed in a cab, and at the time of work that is hard to be visually recognized from the cab, a changeover to an auxiliary operation board is performed to operate an actuator.

For example, Patent Literature 1 discloses an operation device configured to be capable of controlling by an auxiliary operation board only when an overload preventing device is set to a jib overhang and storing mode, the operation device being configured so that a controllable range is limited to a range in which a crane operation needed to extend and store a jib is performed.

CITATION LIST

Patent Literature

Patent Literature 1: JP 2740035 B2

SUMMARY OF THE INVENTION

Problems to be Solved by the Invention

However, in the operation device of the above-described Patent Literature 1, no condition for operating an actuator from the outside of a cab is not taken into consideration and set. Therefore, safety may be impaired by operating the actuator by the auxiliary operation board.

It is an object of the present invention to provide a working machine capable of securing safety while enabling remote operation.

Solutions to Problems

A working machine configured to be capable of communicating with a remote operation device according to the present invention includes a communication unit that receives a manipulate signal from the remote operation device, a control unit that controls actuators mounted in the working machine according to manipulate signals from main operation devices disposed in a cab of the working machine or remote operation device. In a case where a state of the working machine does not fulfill a predetermined condition, the control unit does not allow the remote operation by the remote operation device with respect to at least one of the actuators.

Effects of the Invention

According to the present invention, safety can be secured while remote operation is possible.

DESCRIPTION OF EMBODIMENTS

Hereinafter, an embodiment according to the present invention will be described with reference to drawings. However, constituent components described in the following embodiment are examples, and the technical scope of the present invention is not limited to these constituent components.

Embodiment (Configuration)

First, an entire configuration of a rough terrain crane 1 of the present embodiment that is a mobile crane provided with a remote operation device 40 for actuators will be described using FIG. 1. In the following embodiment, the rough terrain crane 1 will be described as an example of a mobile crane to which the present invention is applied. However, the present invention is not limited to the embodiment and can be applied widely also to mobile cranes such as all terrain cranes.

(Entire Configuration of Crane)

Figure 1:
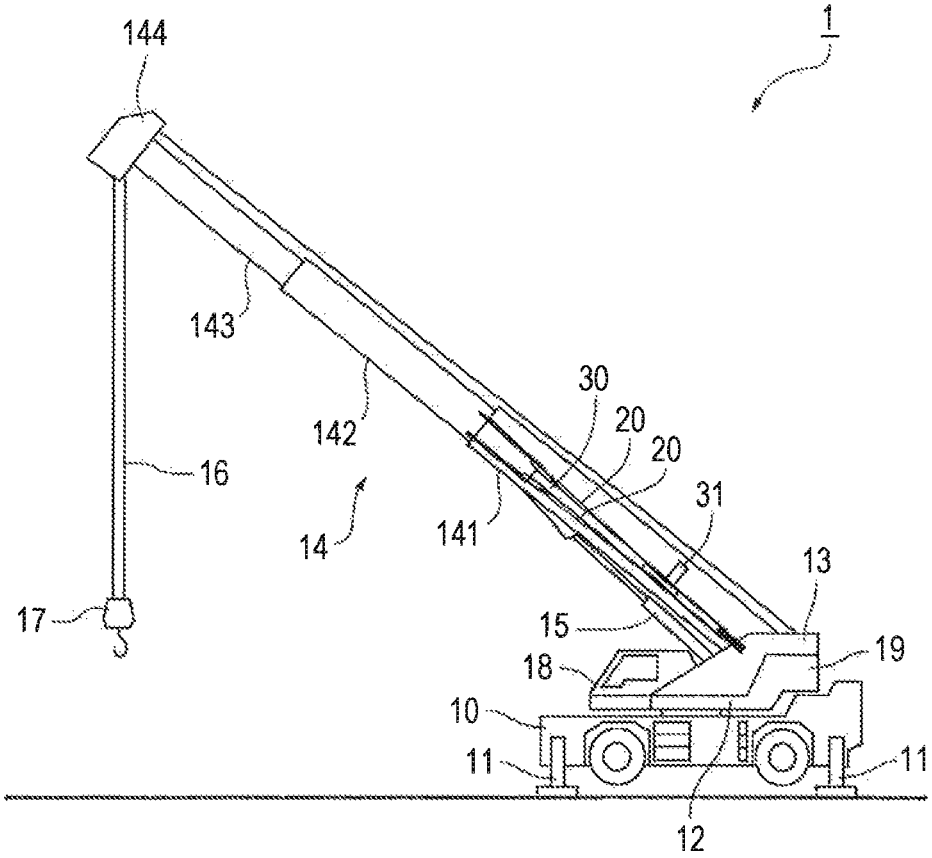
FIG. 1 is a side view of a mobile crane.

As illustrated in FIG. 1, the rough terrain crane 1 of the present embodiment includes a chassis 10 that becomes a body part of a vehicle having a traveling function, outriggers 11 provided at four corners of the chassis 10, . . . , a swivel 12 attached to the chassis 10 in a horizontally pivot able manner, and a boom 14 attached to a bracket 13 install in a standing manner on the swivel 12.

Figure 2:
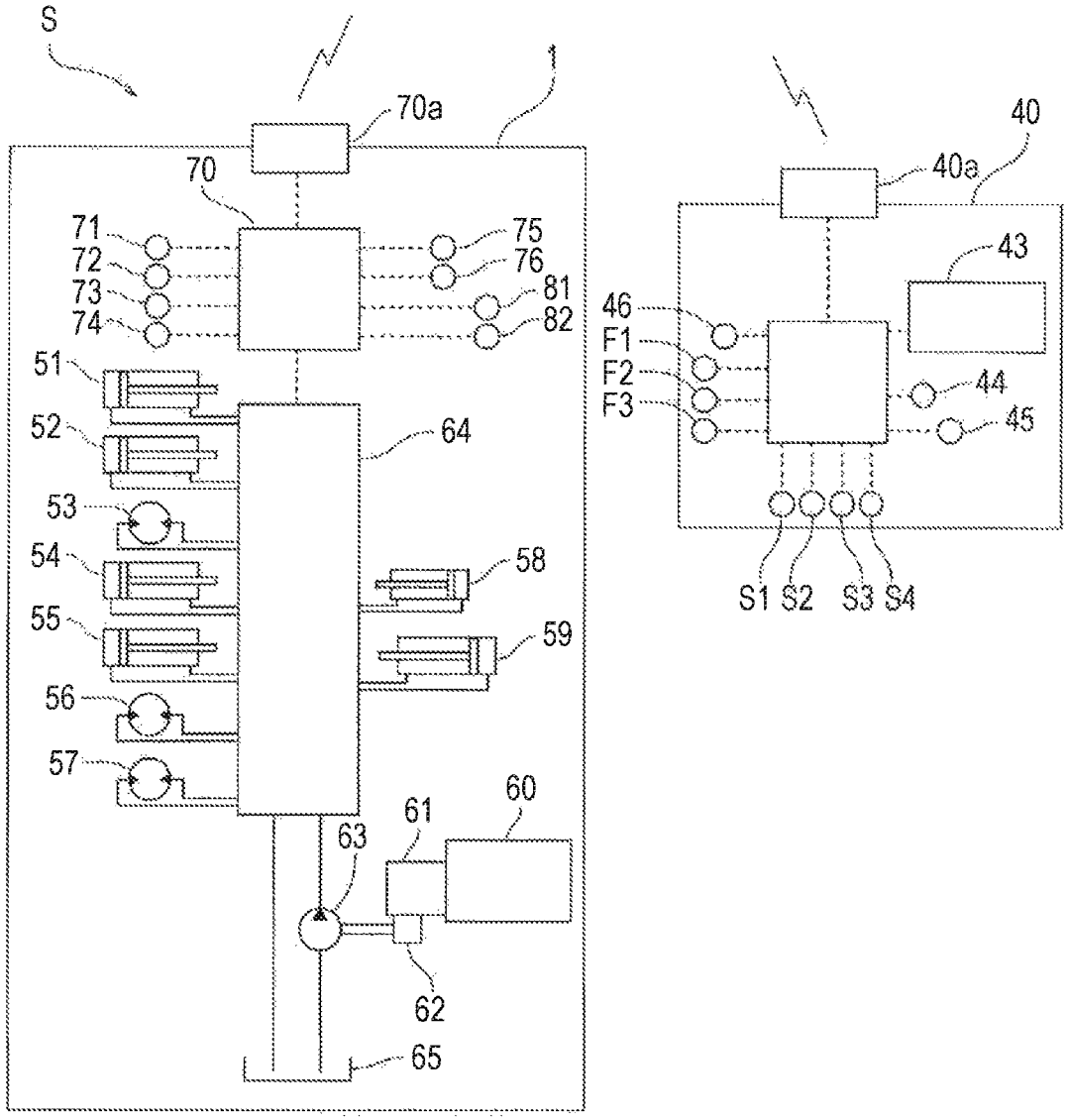
FIG. 2 is a block diagram of a control system according to an embodiment.

In the outrigger 11, slide extension and slide retraction in a width direction from the chassis 10 are possible by extending and retracting a slide cylinder 52 (refer to FIG. 2). Also, jack extension and jack storage in a vertical direction from the chassis 10 are possible by extending and retracting a jack cylinder 51 (refer to FIG. 2).

The swivel 12 includes a pinion gear to which power of a slewing motor is transmitted, and rotates around a pivot by this pinion gear meshing with a circular gear in the chassis 10. The swivel 12 includes at cab 18 disposed on a front right side, the bracket 13 disposed at the rear center part, and a counterweight 19 disposed at a rear lower part. In the cab 18, a switch 75 for turning on a remote operation function, a parking brake switch 76, and the like are disposed (refer to FIG. 2).

The boom 14 is configured in a nesting manner with a base end boom 141, an intermediate boom 142, and a tip boom 143, and can be extended and retracted now by a telescopic cylinder disposed inside. A sheave 144 is disposed at a boom head that is a foremost end of the tip boom 143, a wire rope 16 is wound around the sheave 144, and a hook block 17 is suspended from the sheave 144.

The base end boom 141 on an outermost side is attached rotatably to a support shaft, the base portion of which is installed so as to be horizontal to the bracket 13. The base end boom 141 is configured to be capable of rising and falling with the support shaft as a center of rotation. Furthermore, a derricking cylinder 15 is extended between the bracket 13 and the undersurface of the base end boom 141, and the entire boom 14 can be risen and fell by extending and retracting the derricking cylinder 15.

Furthermore, in the rough terrain crane 1 of the present embodiment, a jib 30 and tension rods 20 and 20 are stored in a laterally held state on a lateral face of the base end boom 141. The jib 30 and the tension rods 20 and 20 are mounted and stored by using a plurality of pins (not illustrated) and a side up cylinder 31.

(Configuration of Control System)

Next, a configuration of a control system, including the remote operation, device 40 in the rough terrain crane 1 of the present embodiment will be described using FIG. 2. The control system of the present embodiment includes, as actuators, four jack cylinders 51, . . . , four slide cylinders 52, . . . , a rotation motor 53, a derricking cylinder 54, a telescopic cylinder 55, a main winch motor 56, and a sub winch motor 57. Furthermore, in the present embodiment, the control system includes, as actuators, a working auxiliary brake 58 that actuates a disc brake of each tire, and a jib extension cylinder 59 for causing the jib 30 to extend and retract as an actuator. These actuators 51 to 59 are controlled by a control valve 64 described later.

Then, the control system of the present embodiment includes, as a hydraulic circuit, a power take-off (PTO) 62 that takes out power from a transmission 61 of an engine 60, a hydraulic pump 63 that rotates by the PTO 62 and pressurizes hydraulic oil from an oil tank 65, and the control valve 64 that controls a flow of the hydraulic oil discharged from the hydraulic pump 63. The control valve 64 includes a group of valves corresponding to the actuators 51 to 59. Each valve is controlled by a controller 70.

The controller 70 is a computer that has a bus, an arithmetic unit, a storage device, and the like. The controller 70 receives a manipulate signals from a rotation lever 71, a derricking lever 72, a telescoping lever 73, a main winch lever 74, and the like, or receives a manipulate signal from a remote operation device 40 via a communication unit 70*a*. The controller 70 controls the actuators 51 to 59 by calculating a moving direction and a movement amount of each valve on the basis of the received manipulate signal, and transmitting a signal to the control valve 64. Furthermore, the controller 70 is configured to receive signals from switches and detectors such as the switch 75 that turns on the remote operation function, the parking brake switch 76, a jib length detector 81, and a boom length detector 82.

Then, in the present embodiment, the controller 70 enables remote operation of the actuators 51 to 59 by a remote operation device 40 only when each condition regarding a state of a mobile crane described later (hereinafter, also referred to as "precondition") is fulfilled. Specifically, only in a case where the precondition is fulfilled, an operator becomes able to turn on the remote operation function in the cab 18. Then, a power source of the remote operation device 40 is turned on only after the remote operation function is turned on. Then, a power source of the remote operation device 40 is turned on only after the remote operation function is turned on. In other words, in a case where the precondition regarding a state of the mobile crane is not fulfilled, the controller 70 does not allow remote operation of at least the actuators 51 to 59 by the remote operation device 40. After the precondition is fulfilled once, the condition does not need to be fulfilled continuously in principle, and the setting of the condition is canceled. Hereinafter, each condition of "the working auxiliary brake is turned on.", "the jib is fully retracted.", and "the length of the boom is 1 m or less.", which are preconditions, will be described.

(Precondition 1: The Working Auxiliary Brake is Turned on.)

Under a situation where the outrigger 11 is not extended, when the tires are grounded, and a bottom board is suspended (when the outrigger 11 is extended on a slope land), there is a possibility that the mobile crane overruns. In order to prevent such overrun, the controller 70 sets, as the above precondition, turning on the "working auxiliary brake (also referred to as the third brake or AUX)" that actuates and brakes a disc brake equipped for each tire by oil pressure. Specifically, the working auxiliary brake is turned on by setting the parking brake switch 76 in the cab 18 to "AUX".

(Precondition 2: The Jib is Fully Retracted.)

In the present embodiment, the controller 70 sets that retraction of all jibs is detected when a connector for a jib angle detection, as the above precondition. This setting is the setting of the condition that the remote operation function is made impossible to be turned on during work with the jib 30 extended. A reason for the setting is that the controller 70 notifies an instruction and fully retracts the jib 30 in the cab 18 before the operator gets down from the cab 18 since the remote operation device 40 is not provided with a jib extending and retracting function. Specifically, in a case where the jib 30 becomes a fully-retracted state by retracting the jib extension cylinder 59 by operation of the operator, the jib length detector 81 detects that the jib 30 is in fully-retracted state. Furthermore, another reason is that although the remote operation function is a function used for work preparation, if the remote operation function is made enabled with the jib 30 extended, a work scope expands, and it becomes possible to perform usual work as well as work preparation. That the remote operation function is enabled with the jib 30 is deterred by a precondition 2. Therefore, the remote operation device 40 is not provided with the extending and retracting function (extending and retracting operation) of the jib 30. Then, since the remote operation device 40 is not provided with the extending and retracting function (extending and retracting operation) of the jib 30, after the precondition 2 is fulfilled once, the precondition 2 does not needs to be fulfilled continuously. The precondition 2 is preferably set as a precondition only at the time of jib work, that is, only in a state in which the connector for a jib angle detection is connected.

(Precondition 3: A Boom Extension Amount is 1 m or Less.)

In the present embodiment, the controller 70 sets that an extension amount of the boom 14 is 1 m or less, as the above precondition. A purpose of this setting is to, by limiting a work scope, limit work by remote operation, which is not allowed to be performed to do usual load suspending work, to work preparation such as suspending the bottom board and attaching and detaching the jib. Furthermore, even after the remote operation function is turned on, only this condition is set continuously as the condition without the setting of the condition being canceled. Specifically, the boom 14 is retracted by retracting the telescopic cylinder 55, and the boom length detector 82 detects this retraction of the boom 14.

(Other Preconditions)

Note that in addition to above-described three preconditions, imposing the following preconditions is conceivable. For example, when that the PTO is turned on is set as a precondition, the remote operation can be limited to the times of work. For example, when that a shift lever is set to N (neutral) is set as a precondition, the remote operation in a traveling state can be prevented. For example, when a revolution freelancer is turned off is set as a precondition, revolution by an inclination or a wind can be prevented. Note that when the revolution freelancer is turned off automatically, if the remote operation device is turned off, there is a possibility that the revolution freelancer may be turned on suddenly to cause danger. For example, when that there is no error accompanied by an auto moment limiter (AML) vent is set as a precondition, remote operation in a state in which an important error occurs can be prevented. For example, when that no load is detected is set as a precondition, an operation mistake with a load suspended can be prevented. For example, when that there is no operation by operating levers 71 to 74 is set as a precondition, this setting can prevent the remote operation function from being turned on mistakenly and, as a result, can prevent the actuators from stopping suddenly.

Figure 3:
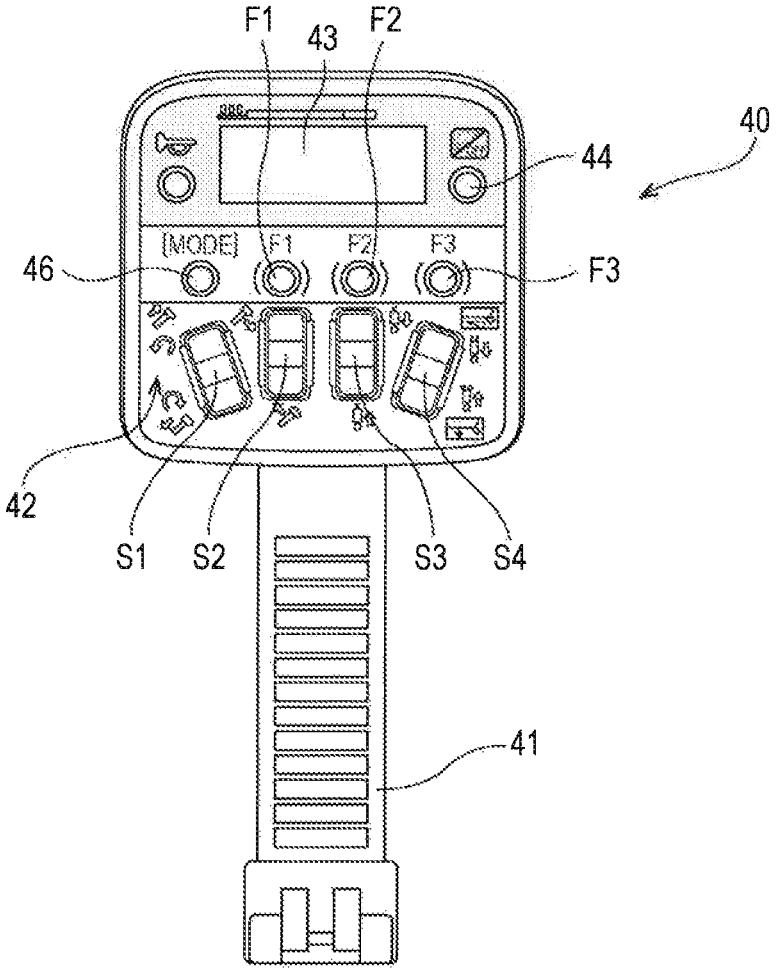
FIG. 3 is a front view of the remote operation device.
Figure 4:
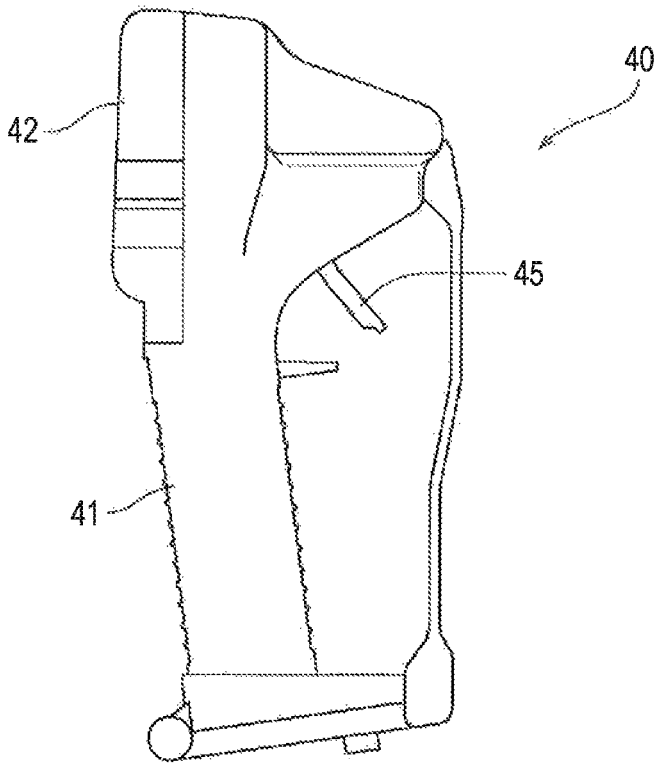
FIG. 4 is a side view of the remote operation device.

The remote operation device 40 includes an operation face 42 for operating the actuators 51 to 59, and a gripper unit 41 extending below the operation face 42 and grasped by hand, as illustrated in FIGS. 2, 3 and 4. Additionally, the remote operation device 40 includes a communication unit 40*a*, gives an instruction to the controller 70 via the communication unit 70*a* of the controller 70 and obtains information from the controller 70 by operating lever switches S1 to S4 and setting buttons F1 to F3 described later. A trigger 45 operated by an index finger with the gripper unit 41 gripped is disposed at a back side of the gripper unit 41. However, when any of the above-described preconditions is not fulfilled, the remote operation function is not turned on on a side of the controller 70. Therefore, the power source of the remote operation device 40 is not turned on, and the actuators cannot be operated via the controller 70.

The operation face 42 includes a display unit 43 disposed at the upper part, an electric power switch 44 disposed to the right of the display unit 43, a mode button 46 disposed at the lower left of the display unit 43, the three setting button F1, F2, and F3 disposed in sequence to the right of the mode button 46, a revolution lever switch S1, a derricking lever switch S2, a sub winch lever switch S3, and a main winch lever switch S4, which serve as four selecting means, are disposed at the lower part and corresponds to the mode button 46, the setting buttons F1, F2, and F3.

Thus, a safety device S of the mobile crane according to the present invention includes the remote operation device 40 that is provided separately from the main operation devices (operating levers) 71-74 and operates the actuators 51 to 59, the controller 70 as a control unit that activates the actuators 51 to 59.

(Actions)

Next, the actions of the safety device S of the mobile crane according to the present embodiment will be described using a flow chart of FIG. 5.

First, the operator turns on the switch 75 in the cab 18, thereby operating to turning on the remote operation function (also referred to as a radio control function) (step S1). Actually, at this time, the remote operation function is not turned on and the power source of the remote operation device 40 is also not turned on.

When an operation of turning on the remote operation function is performed, it is determined whether the working auxiliary brake (also referred to as AUX) brake 58 is turned on (step S2). Specifically, the controller 70 determines whether the parking brake switch 76 in the cab 18 is set to an AUX position. When the working auxiliary brake 58 is turned on (step S2: YES), the process proceeds to step S3. When the working auxiliary brake 58 is not turned on (step S2: NO), the controller 70 notifies an instruction to turn on the working auxiliary brake 58 (step S21).

When the working auxiliary brake 58 is turned on, it is determined whether the jib 30 is in fully-retracted state (step S3). Specifically, the controller 70 determines whether the jib 30 is in a fully-retracted state on the basis of a length detected by the jib length detector 81. When the jib 30 is fully retracted (S3: YES), the process proceeds to step S4. When the jib 30 is nor fully retracted (step S3: NO), the controller 70 notifies an instruction to fully retract the jib 30 (step S31).

When the jib 30 is fully retracted, it is determined whether a boom extension amount is 1 m or less (step S4). Specifically, the controller 70 determines whether the boom extension amount is 1 m or less on the basis of a length detected by the boom length detector 82. When the boom extension amount is 1 m or less (step S4: YES), the process proceeds to step S5. When the boom extension amount is not 1 m or less (step S4: NO), the controller 70 notifies an instruction to retract the boom 14 (step S41).

When the boom extension amount is 1 m or less, a determination regarding the other conditions is performed (step S5). Specifically, the controller 70 performs a determination regarding the other conditions. When the other conditions are fulfilled (step S5: YES), the process proceeds to step S6. When the other conditions are not fulfilled (step S5: NO), the controller 70 notifies an instruction to fulfill the other conditions (step S51).

When the other conditions are fulfilled, the controller 70 actually turns on the remote operation function (step S6). Furthermore, when the remote operation function is turned on, the power source of the remote operation function 40 can also be turned on.

(Effects)

Next, effects achieved by the safety device S of the mobile crane of the present embodiment will be listed and described.

(1) As described above, the safety device S of the mobile crane of the present embodiment includes the remote operation device 40 that is provided separately from the main operation devices disposed in the cab 18 and operates the actuators remotely, the remote operation device 40 being used for work preparation of the mobile crane, and the controller 70 as a control unit that activates the actuators in response to instructions by the remote operation device 40. Then, the controller 70 is configured to enable remote operation of the actuators by the remote operation device 40 only when preconditions for work preparation of the mobile crane are fulfilled. Thus, the safety of work preparation can be improved by imposing the preconditions for work preparation.

(2) Additionally, the controller 70 as a control unit can be configured to enable remote operation of the actuators by the remote operation device 40 only when the working auxiliary brake is turned on, as the precondition. According to such configuration, when tires are grounded, and a bottom board, is suspended under a situation where the outrigger 11 is not extended (when the outrigger 11 is extended on a slope land), an overrun of the mobile crane can be prevented.

(3) Furthermore, the controller 70 as a control unit can be configured to enable remote operation of the actuators by the remote operation device 40 only when the jib 30 is fully retracted, as the precondition. That is, the remote operation function is configured so as to not be able to be turned on during work with the jib 30 extended. With this configuration, when attaching and detaching work of a jib 30 is performed, the controller 70 can notify an instruction and fully retract the jib 30 in the cab 18 before the operator gets down from the cab 18 since the remote operation device 40 is not provided with the jib extending and retracting function. Conversely, in a case where the full retraction of the jib 30 is not set as a precondition, after the operator gets down, from the cab 18, the operator realizes that the jib 30 is not fully retracted, the operator gets onto the cab 18 once, retracts the jib 30 and then resumes the detaching work of the jib 30. Furthermore, by setting the full retraction of the jib 30 as the precondition, a work scope is limited to a narrow scope. Therefore, it becomes difficult to do usual work using the jib 30. As a result, the remote operation of the actuators by the remote operation device 40 can be limited to work preparation.

(4) Additionally, the controller 70 as a control unit can be configured to enable remote operation of the actuators by the remote operation device 40 only when the extension amount of the boom 14 is a predetermined amount or less, as the precondition. According to such configuration, by limiting a work scope, remote operation, which is not allowed to be performed to do usual load suspending work, can be limited to work preparation such as suspending the bottom board and attaching and detaching the jib.

(5) Note that in addition to above-described three preconditions, the following preconditions are conceivable. For example, when that the PTO is turned on is set as a precondition, the remote operation can be limited to the times of work. For example, when that a shift lever is set to N (neutral) is set as a precondition, the remote operation in a traveling state can be prevented. For example, when a revolution freelancer is turned off is set as a precondition, revolution by an inclination or a wind can be prevented. For example, when that there is no error accompanied by an AML vent is set as a precondition, remote operation in a state in which an important error occurs can be prevented. For example, when that no load is detected is set as a precondition, an operation mistake with a load suspended can be prevented. For example, when that there is no operation by operating levers 71 to 74 is set as a precondition, this setting can prevent the remote operation function from being turned on mistakenly and, as a result, can prevent the actuators front stopping suddenly.

As described above, the embodiment of the present invention has been described in detail with reference to the drawings. However, a specific configuration is not limited to this embodiment, and design changes to the extent the changes do not deviate from a gist of the present invention are included in the present invention.

For example, in the embodiment, there has been described that if all of the three preconditions are not fulfilled, the remote operation function is not turned on. However, the present embodiment is not limited to this configuration. When only any one or two of the three preconditions are fulfilled, the remote operation function can also be turned on.

Furthermore, although description has not specially been given in the embodiment, there can be employed a configuration in which, when a precondition is not fulfilled, a warning is issued while the remote operation function is turned on and the remote operation of the actuators is enabled.

Additionally, although description has not specially been given in the embodiment, there can be employed a configuration in which, when a precondition is of low importance, the operator can choose whether to adopt or not to adopt the precondition.

Figure 5:
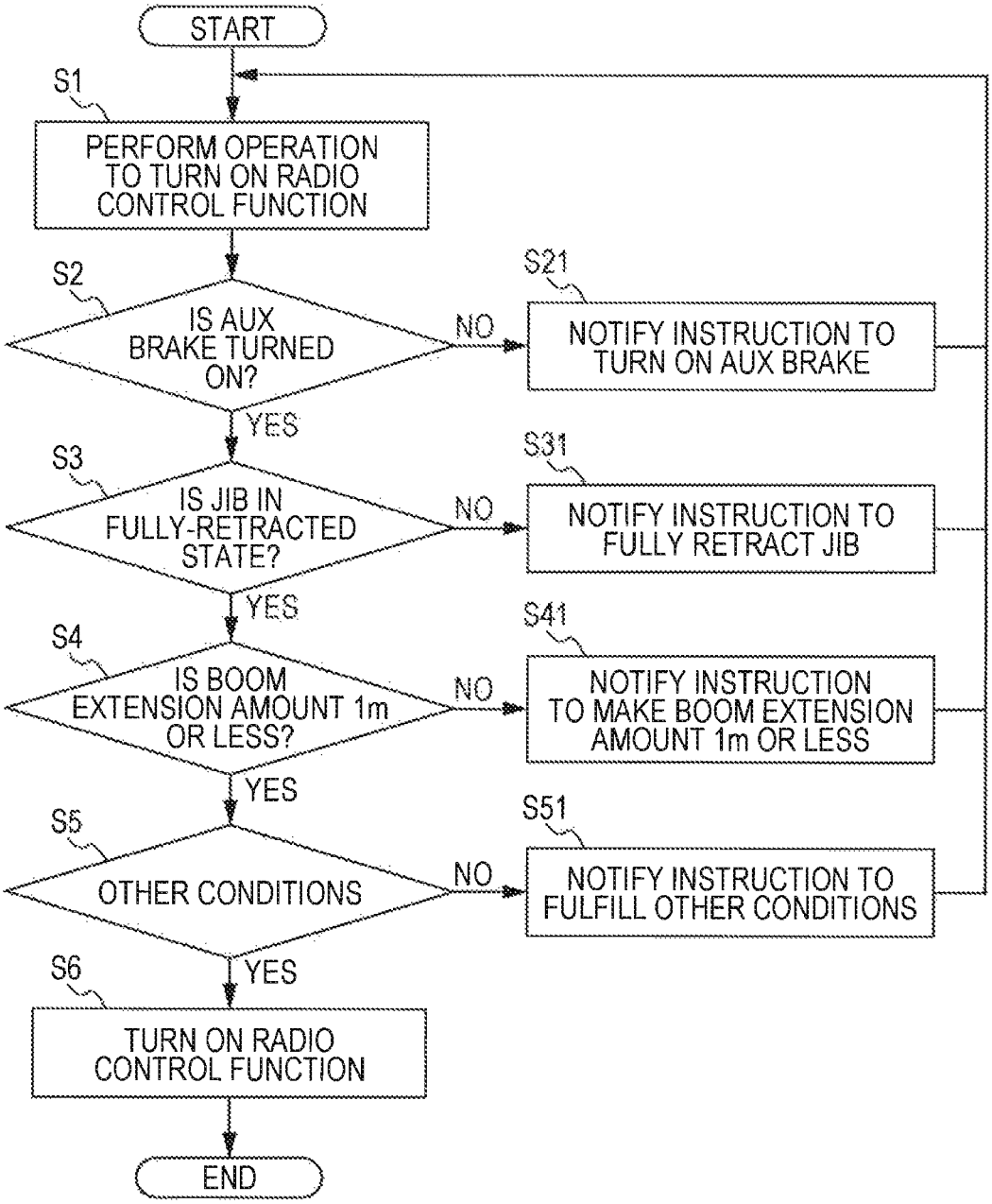
FIG. 5 is a flow chart of preconditions of the embodiment.

Furthermore, in the flow chart illustrated in FIG. 5, the preconditions for work preparation are checked sequentially, and preconditions that are not fulfilled are notified one by one. However, the present embodiment is not limited to this configuration, and can be configured to temporarily store preconditions that are not fulfilled and notify the preconditions all at once at the end.

REFERENCE SIGNS LIST

1 Rough terrain crane (mobile crane)
10 Chassis
11 Outrigger
12 Swivel
14 Boom
18 Cab
20 Tension rod
30 Jib
40 Remote operation device
40*a* Communication unit
41 Gripper unit
42 Operation face
43 Display unit
44 Electric power switch
45 Trigger
46 Mode button
F1 to F3 Setting button
S1 Revolution lever switch
S2 Derricking lever switch
S3 Sub winch lever switch
S4 Main winch lever switch
58 Working auxiliary brake
59 Jib extension cylinder
70 Controller
70*a* Communication unit
75 Switch
76 Parking brake switch
81 Jib length detector
82 Boom length detector

The invention claimed is:

1. A working machine configured to be capable of communicating with a remote operation device, the working machine comprising:

a communication unit that receives a manipulate signal from the remote operation device; and a control unit that controls an actuator mounted in the working machine according to a manipulate signal from a main operation device disposed in a cab of the working machine or the remote operation device, wherein in a case where a state of the working machine does not fulfill any of a plurality of predetermined conditions, the control unit is configured not to allow remote operation of the actuator by the remote operation device, wherein the plurality of predetermined conditions includes a first condition that remote operation by the remote operation device is allowed once a state of a first operating part of the working machine is fulfilled, a second condition that remote operation by the remote operation device is allowed only while a state of a second operating part of the working machine is fulfilled, and the first condition and the second condition are selectively set according to each operating part of the working machine, and wherein in a case where any of the plurality of predetermined conditions is not fulfilled, the control unit informs contents corresponding to each condition that is not fulfilled.

2. The working machine according to claim 1, wherein the working machine is a mobile crane.

3. The working machine according to claim 2, wherein the second operating part comprises a boom of the working machine, and wherein the second condition includes that an extension amount of the boom of the working machine is a predetermined amount or less.

4. The working machine according to claim 2, wherein the first operating part comprises a working auxiliary brake of the working machine, and wherein the first condition includes that the working auxiliary brake of the working machine is turned on.

* * * * *